US009559403B2

(12) United States Patent
Kohl

(10) Patent No.: US 9,559,403 B2
(45) Date of Patent: Jan. 31, 2017

(54) BROADBAND SIGNAL JUNCTION WITH SUM SIGNAL ABSORPTION

(71) Applicant: Airbus DS GmbH, Taufkirchen (DE)

(72) Inventor: Philipp Kohl, Steinhoering (DE)

(73) Assignee: Airbus DS GmbH, Taufkirchen (DE)

( * ) Notice: Subject to any disclaimer, the term of this patent is extended or adjusted under 35 U.S.C. 154(b) by 1 day.

(21) Appl. No.: 14/598,374

(22) Filed: Jan. 16, 2015

(65) Prior Publication Data

US 2015/0207201 A1 Jul. 23, 2015

(30) Foreign Application Priority Data

Jan. 17, 2014 (DE) ..... 10 2014 000 438

(51) Int. Cl.
*H01P 1/26* (2006.01)
*H01P 5/19* (2006.01)
*H01P 1/161* (2006.01)

(52) U.S. Cl.
CPC ..... *H01P 5/19* (2013.01); *H01P 1/161* (2013.01)

(58) Field of Classification Search
CPC ..... H01P 3/12; H01P 3/123; H01P 5/19; H01P 5/20
USPC ..... 333/122, 135, 137, 248, 21 A
See application file for complete search history.

(56) References Cited

U.S. PATENT DOCUMENTS 3,581,245 A 5/1971 Ohi et al.
6,642,905 B2 * 11/2003 Bien ..... H01P 1/161 343/772
7,019,603 B2 * 3/2006 Yoneda ..... H01P 11/002 333/122
7,091,804 B2 * 8/2006 Aramaki ..... H01P 1/062 333/21 A
7,095,380 B2 * 8/2006 Yoneda ..... H01P 1/063 343/776
7,397,323 B2 * 7/2008 Tavassoli Hozouri .. H01P 1/161 333/117

(Continued)

FOREIGN PATENT DOCUMENTS

WO WO 93/02482 A1 2/1993

OTHER PUBLICATIONS

Maurice A. Meyer, et al., "Applications of the Turnstile Junction", IRE Transactions—Microwave Theory and Techniques, Dec. 1955, No. 6, pp. 40-45 (six (6) pages).

(Continued)

*Primary Examiner* — Dean Takaoka
(74) *Attorney, Agent, or Firm* — Crowell & Moring LLP

(57) ABSTRACT

A broadband signal junction with sum signal absorption for transmitted signals includes a common hollow conductor with a first predefined cross-section and four laterally-disposed side arm hollow conductors with a predefined cross-section. The cross-sections of the side arm hollow conductors can also be selected to be different. Two first opposing side arm hollow conductors of the four side arm hollow conductors extend along a first axis. Two second opposing side arm hollow conductors of the four side arm hollow conductors extend along a second axis. The first and the second axes are disposed orthogonal to one another and lie in the common plane. The broadband signal junction with sum signal absorption is characterized in that the two first side arm hollow conductors end with a hollow conductor absorber.

8 Claims, 4 Drawing Sheets

(56) References Cited

U.S. PATENT DOCUMENTS

| | | | | |
|---|---|---|---|---|
| 7,920,034 | B1 * | 4/2011 | Sorensen | H01P 1/264 333/22 R |
| 2002/0089398 | A1 * | 7/2002 | Wolk | H01P 1/30 333/248 |
| 2005/0200430 | A1 | 9/2005 | Aramaki et al. | |
| 2012/0032867 | A1 * | 2/2012 | Fonseca | H01P 1/161 343/850 |
| 2013/0342282 | A1 * | 12/2013 | Uher | H01P 1/161 333/135 |

OTHER PUBLICATIONS

Meyer et al. "Applications of the Turnstile Junction", IRE Transactions—Microwave Theory and Techniques, 1955, pp. 40-45, (six (6) pages).
European Office Action dated May 18, 2015, with English translation (Six (6) pages).

* cited by examiner

BROADBAND SIGNAL JUNCTION WITH SUM SIGNAL ABSORPTION

CROSS-REFERENCE TO RELATED APPLICATIONS

This application claims priority under 35 U.S.C. §119 to German patent application 10 2014 000 438.4, filed Jan. 17, 2014, the entire disclosure of which is herein expressly incorporated by reference.

BACKGROUND AND SUMMARY OF THE INVENTION

Exemplary embodiments of the invention relate to a broadband signal junction with sum signal absorption (BSmS) for transmitting signals over a predefined bandwidth corresponding to the maximum bandwidth of a conventional T junction.

Such a broadband signal junction with sum signal absorption (BSmS) comprises a common hollow conductor with a first predefined cross-section and four side arm hollow conductors with a predefined second cross-section. Two first opposing side arm hollow conductors extend along a first axis. Two second opposing side arm hollow conductors extend along a second axis, wherein the first and second axes are disposed orthogonal to one another. The common plane runs orthogonal to a main axis of the common hollow conductor.

An orthomode coupler (orthomode transducer, OMT) is a passive component in microwave technology. It is used to split or combine orthogonally polarized electromagnetic waves. Current communications systems at this time consist of a satellite receiver and satellite transmitter with antennae for satellite supported communications. In such systems, the orthomode coupler assumes the function of a diplexer or circulator when received signals and transmitted signals are orthogonally polarized, and routes both signals together through an antenna.

Minor asymmetrical discontinuities can occur here due to manufacturing imprecision. This results in phase differences in the different electromagnetic waves, and ultimately leads to undesirable interference signals when the individual waves are combined. When the signals are combined, the relative phase shift in the individual propagation paths of the electromagnetic waves deviates slightly from a target value of 180°. If two signals are now subtracted from one another a substantial fraction of the sum remains, the amplitude of which depends on the deviation of the phase from the target value.

Figure 4:
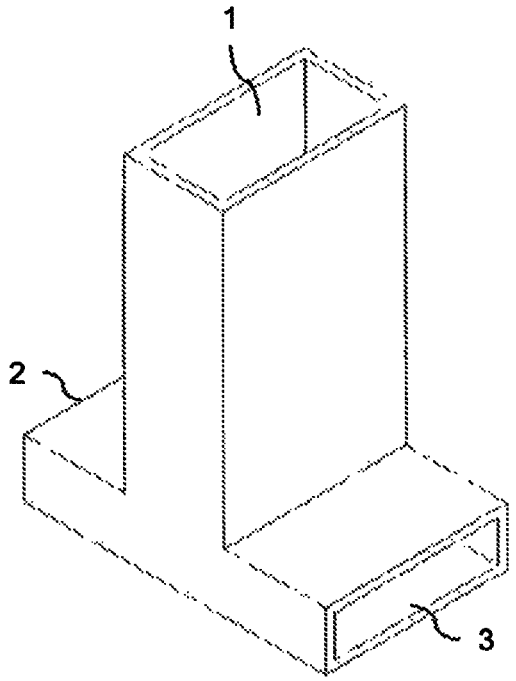

Such sum signals arise when conventional T junctions are used as a signal junction, as shown in FIG. 4, due to manufacturing tolerances. Because of the high quality of the orthomode coupler inside an antenna feed network, the sum signals resonate and cannot be absorbed for lack of a sum signal hollow conductor (port). This gives rise to undesired resonance peaks in the scatter parameters.

An advantage to the conventional T junction, as is shown in FIG. 4, is that it covers the maximum hollow conductor bandwidth of transmittable frequencies. If a signal is fed in at the so-called delta port of the symmetrical T junction, identified with 1, it splits to the two collinear side arms 2, 3 into −3 dB each of the output with a phase shift of ideally 180°, wherein the phase shift as described above can unfavorably deviate from 180° depending on manufacturing tolerances.

To dampen the resonance peaks, it is common to use a so-called magic T junction as a signal junction for coupling a signal instead of the conventional T junction. The sum signals that arise due to a relative phase shift are absorbed into the material of the hollow conductor absorber in this orthomode coupler.

In high-frequency technology, a hybrid or 3 dB coupler is called a magic T junction or hybrid tee. This component is used in microwave components in practice. It is a fixed power alternative to a rat race coupler used in microstrip line technology. The magic tee is a combination of an E-plane and an H-plane T junction. To guarantee correct functionality, a so-called matching structure is provided inside the magic T junction. The magic T junction only operates within a specific frequency range and the transmission behavior varies very significantly with the geometry of the matching structure.

Figure 5:
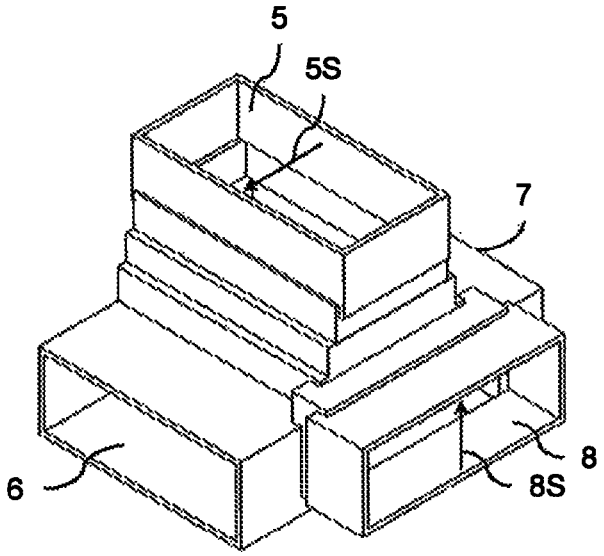

The name magic T junction is derived from the electrical power flow inside the junction. An example of a magic T junction is shown in FIG. 5. A signal fed in at sum gate 8 splits to collinear side arms 6, 7 with identical amplitudes and phase positions.

In contrast, a signal fed in at difference gate 5 of the magic T junction splits to side arms 6, 7 with the same amplitude but a phase shift of 180°. The electrical field of the dominant field wave type in each gate is perpendicular to the broad side of the hollow conductor. This causes the signals 5S, 8S in the E-plane gate (difference gate 5) and in the H-plane gate (sum gate 8) to be polarized orthogonal to one another. As described, this variant is limited to about 40% of the bandwidth of conventional T junctions, which is a disadvantage.

Therefore, exemplary embodiments of the present invention are directed to a waveguide signal junction that suppresses undesirable resonance peaks in the scatter parameters at large bandwidths, in particular at a bandwidth corresponding to the bandwidth of a conventional T junction.

In accordance with exemplary embodiments of the present invention a waveguide signal junction for transmitting signals comprises a common hollow conductor with a first predefined cross-section and four side arm hollow conductors with a predefined cross-section. The cross-sections of the side arm hollow conductors can also vary. Two first opposing side arm hollow conductors of the four side arm hollow conductors extend along a first axis. Two second opposing side arm hollow conductors extend along a second axis. The first and second axes are disposed orthogonal to one another. In the broadband signal junction with sum signal absorption (BSmS) the two first side arm hollow conductors end at a hollow conductor absorber.

The broadband signal junction with sum signal absorption (BSmS) allows for the design of orthomode couplers that make it possible to increase the bandwidth and to significantly dampen the resonance peaks in the scatter parameters arising due to manufacturing tolerances. In particular, the broadband signal junction with sum signal absorption (BSmS) according to the invention is capable of being operated at a bandwidth corresponding to the bandwidth of a conventional T junction as is shown in FIG. 4, for example. The energy of the sum signals is decoupled to the side arm hollow conductors ending with the hollow conductor absorber and absorbed in the hollow conductor absorbers.

The first predefined cross-section of the common hollow conductor can be rectangular. The first predefined cross-section of the common hollow conductor can be square. The first predefined cross-section of the common hollow conductor can be elliptical. The first predefined cross-section of the common hollow conductor can be round. The first predefined cross-section of the common hollow conductor can basically have any arbitrary cross-section.

The second predefined cross-section of the four side arm hollow conductors can be rectangular. The second predefined cross-section of the four side arm hollow conductors can be square. The second predefined cross-section of the four side arm hollow conductors can be elliptical. The second predefined cross-section of the four side arm hollow conductors can be round. The second predefined cross-section of the four side arm hollow conductors can basically have any arbitrary cross-section.

According to another embodiment, the two second side arm hollow conductors can be disposed and/or designed in collinear fashion.

In another embodiment, the four side arm hollow conductors can be disposed or designed as displaced out of the common plane so that sets of two side arm hollow conductors are disposed in a common plane, respectively, for example, wherein the two planes are different planes. These two planes can be disposed parallel to one another or not parallel.

Furthermore, a matching structure can be provided inside the broadband signal junction with sum signal absorption (BSmS), in particular inside the common hollow conductor, the geometry of the structure being matched to a desired transmission behavior. For example, the matching structure is designed analogous to a magic T junction.

In another embodiment, the broadband signal junction with sum signal absorption (BSmS) according to the invention distributes or couples signals over an overall bandwidth with a phase shift of 180°.

BRIEF DESCRIPTION OF THE DRAWING FIGURES

Figure 1:
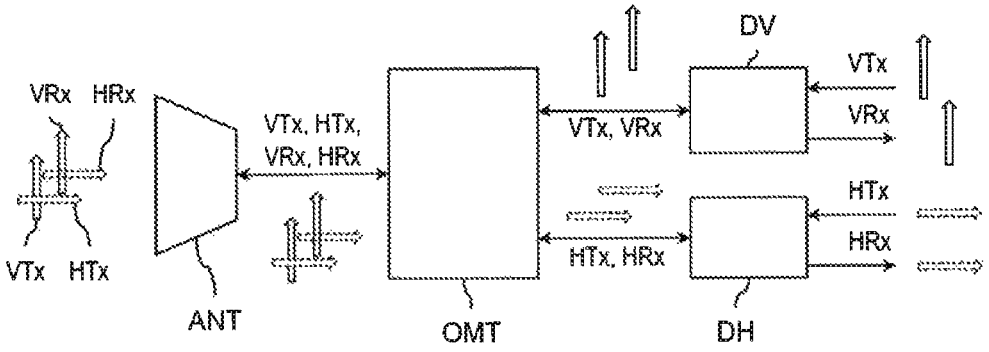
Figure 2:
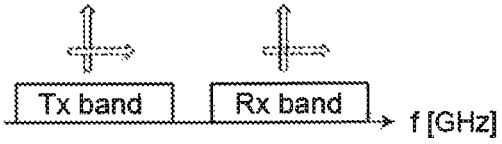
Figure 3:
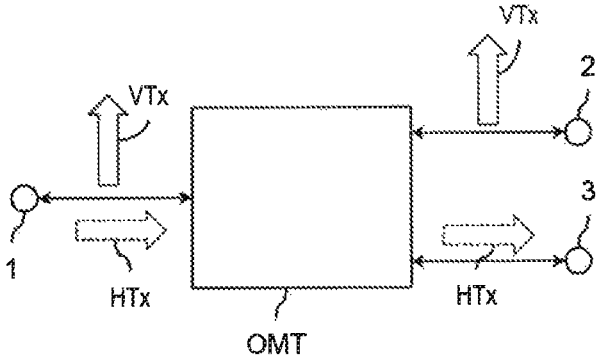
Figure 6:
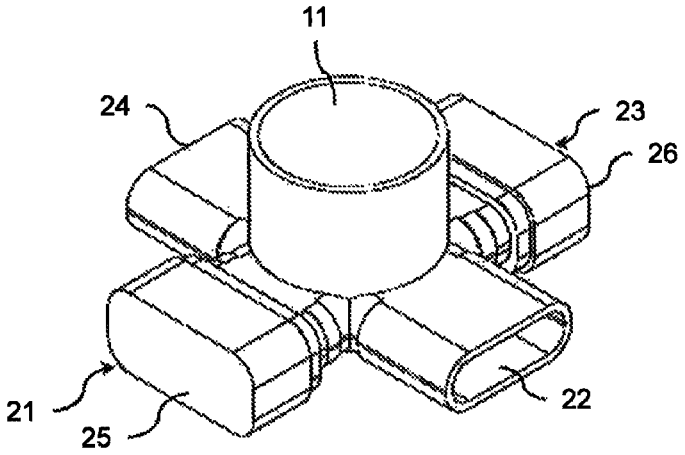
Figure 7:
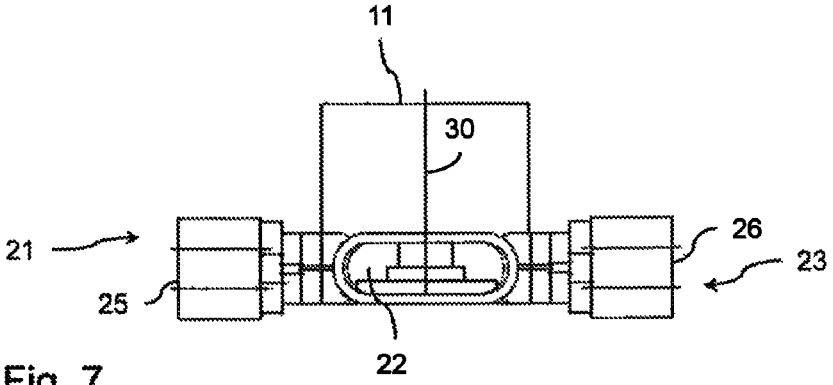
Figure 8:
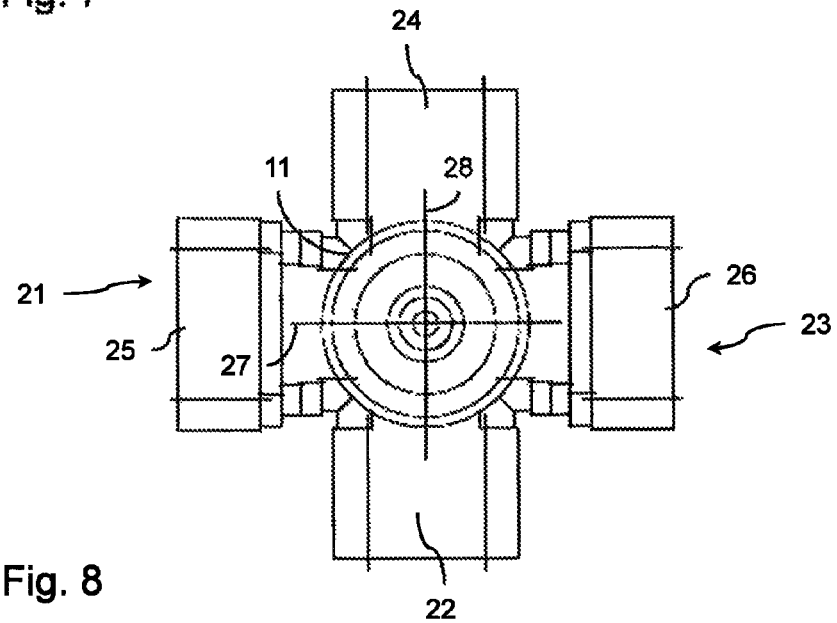
Figure 9:
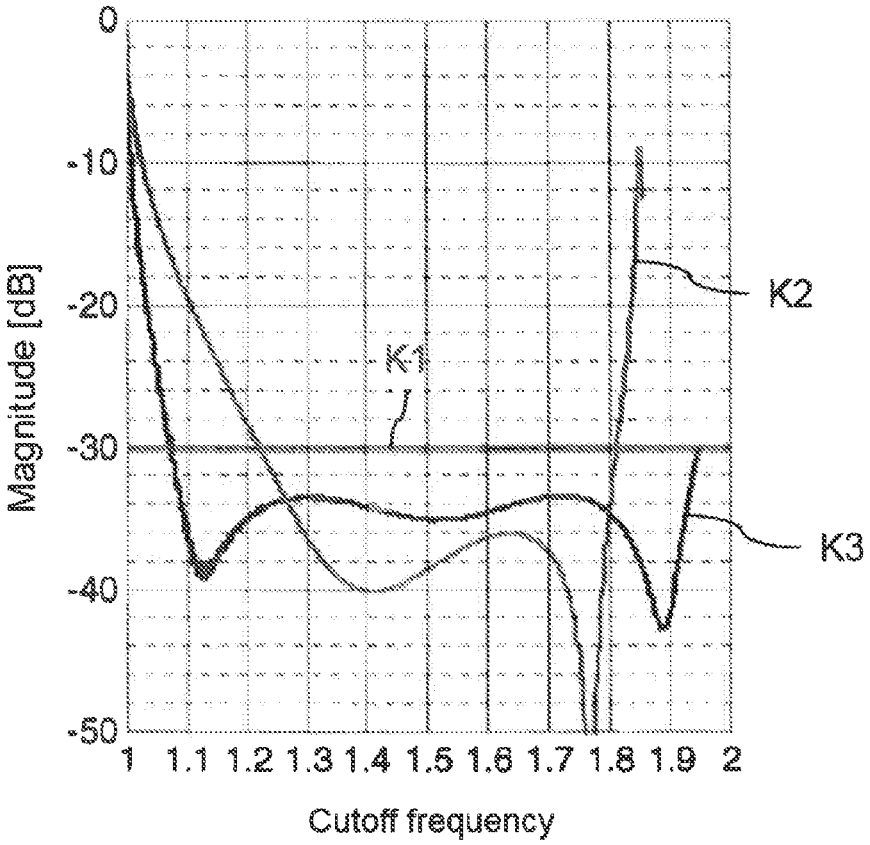

The invention is described in more detail below with the help of exemplary embodiments in the drawing. Shown are:

FIG. 1 a known signal chain with components typical for a telecommunications satellite;

FIG. 2 a schematic representation of the use of adjacent frequency bands for transfer of transmitted and received signals:

FIG. 3 a schematic representation of a typical orthomode coupler;

FIG. 4 a known conventional T junction;

FIG. 5 a known magic T junction;

FIG. 6 a perspective view of the broadband signal junction with sum signal absorption according to the invention;

FIG. 7 a side view of the broadband signal junction with sum signal absorption according to the invention from FIG. 6;

FIG. 8 a top view of the broadband signal junction with sum signal absorption according to the invention from FIG. 6 and FIG. 9 a comparison of return loss parameters of the broadband signal junction with sum signal absorption according to the invention and of a magic T junction.

DETAILED DESCRIPTION

The antenna design of a common telecommunications payload of a conventional satellite is based on electromagnetic, thermomechanical, technological, and design-based boundary conditions. The primary goal in the design of antennas for a telecommunications payload is to maximize the amplification of the electromagnetic waves over a complex-shaped geographical zone. It is also desirable to have a large useful bandwidth. To this end, multiple use of frequency and polarization in a manner known to those trained in the art is utilized. Another requirement is high power strength.

To control currently available horn antennas (so-called feed horns) with dual polarization utilization, an antenna feed network (a so-called feed chain) is used, which allows two linear or circularly polarized orthogonal signals that the satellite receives and sends to be combined and split.

FIG. 1 shows a block diagram of a typical signal chain of a telecommunications satellite. The system can process signals with orthogonal polarization in both the transmission (Tx) band as well as the reception band (Rx). A vertically polarized transmission signal is identified by VTx and shown with a vertical arrow with a solid line. A horizontally polarized transmission signal is identified by HTx and shown with a horizontal arrow with a dashed line. A vertically polarized reception signal is identified by VRx and shown with a vertical arrow with a solid line. A horizontally polarized reception signal is identified by HRx and shown with a horizontal arrow with a dashed line. The transmission signals VTx, HTx are also provided with hatching.

The interface between an antenna ANT and the payload, in other words the antenna feed network, is made up of an orthomode coupler (orthomode transducer) OMT. In the receiving case, the orthomode coupler OMT splits the antenna signals VRx, HRx in a broadband manner into the orthogonal portions according to the polarization of the signals (vertical (V) or horizontal (H)) before the signals are split by frequency into the transmission (Tx) and reception band (Rx) in an associated transmission/reception diplexer DV, DH. Conversely, in the transmission case the orthomode coupler OMT combines the vertically and horizontally polarized signals VTx, HTx, which are fed to the coupler by the diplexers DV, DH, and feeds them to the antenna ANT for broadcasting. In this way, the satellite is able to process four independent signals. The known splitting of a frequency range f into a frequency band for transmission signals (Tx band) and reception signals (Rx band) is shown schematically in FIG. 2.

The heart of the antenna feed network is thus the orthomode coupler OMT, which splits the antenna signals according to the polarization thereof into the orthogonal components. In order to further maximize the transmission capacity, broadband-matched structures are used with which a larger or largest possible frequency range utilization can be implemented.

As shown schematically in FIG. 3, a conventional orthomode coupler OMT comprises a hollow conductor 1 with circular or square cross-section, the conductor being connected to the antenna ANT (see FIG. 1). A rectangular hollow conductor 2, 3 is connected both to the diplexer DV for vertically polarized signals and to the diplexer DH for horizontally polarized signals. As described at the beginning in connection with FIGS. 4 and 5, such an orthomode coupler can be made up of a conventional T junction or a magic T junction, wherein the conventional T junction exhibits undesirable resonance peaks in the scatter parameters due to unavoidable manufacturing tolerances and the magic T junction has the disadvantage of a smaller bandwidth by comparison.

The proposed broadband signal junction with sum signal absorption (BSmS), which is shown in FIGS. 6 to 8, avoids these disadvantages and simultaneously enables an increase in the bandwidth as well as a stronger damping of the resonance peaks in the scatter parameters caused by the manufacturing tolerances.

The broadband signal junction with sum signal absorption (BSmS), which is matched over the entire rectangular hollow conductor bandwidth, comprises four side arm hollow conductors (side gates) 21, 22, 23, 24 with rectangular, elliptical or any other cross-section, wherein the side arm hollow conductors 21, 22, 23, 24 are disposed symmetrically in a plane. In the process, opposing side arm hollow conductors 21, 23 extend along a first axis 27 and opposing side arm hollow conductors 22, 24 extend along a second axis 28. The first and the second axis 27, 28 are disposed orthogonal to one another and lie in a common plane. The common plane runs orthogonal to a main axis (longitudinal axis) 30 of a common hollow conductor 11. The common hollow conductor 11 can be a square, elliptical, round hollow conductor or a hollow conductor with any arbitrary shape. In the present description, it is designed as a round hollow conductor.

The opposing side arm hollow conductors 21, 23 end symmetrically with a respective hollow conductor absorber 25, 26. The hollow conductor absorbers 25, 26 are pushed over the side arm hollow conductors 21, 23 similar to a cap or are located inside the side arm hollow conductors. The hollow conductor absorbers 25, 26 comprise an electrically and or a magnetically dissipative material (for example ECCOSORB® manufactured by Emerson & Cuming Microwave Products, Inc.).

Inside the hollow conductor arrangement, a matching structure can be provided, which is not further shown, the geometry of which is matched to a desired transmission behavior.

The broadband signal junction with sum signal absorption (BSmS) combines four symmetrically disposed rectangular hollow conductors 21, 22, 23, 24 (or hollow conductors of any other arbitrary shape) using a common hollow conductor 11. This mechanical 5-gate combines the function of a conventional T junction with the function of a magic T junction in an antenna feed network. Transmission and reception signals can thereby be split and coupled as in a conventional T junction over the entire hollow conductor bandwidth with a phase shift of 180°.

The sum signals resulting from manufacturing imprecision, which resonate inside the orthomode coupler, are absorbed in the two hollow conductor absorbers 25, 26 of the orthomode coupler.

A comparison of the return loss parameters between a magic T junction and a broadband junction is shown in FIG. 9. In this figure, the frequency range is shown in normalized mode. Typical values for the required return loss parameters are usually at about −30 dB (curve K1). Curve K2 shows the plot of the return loss parameters for the magic T junction. The curve of the return loss parameters for the broadband signal junction with sum signal absorption (BSmS) according to the invention is identified by K3. In FIG. 9 it can be seen that with the symmetrical broadband signal junction with sum signal absorption (BSmS) the return loss parameters are better than −30 dB over a relative frequency range of about 60%. In contrast, with the magic T junction only about 40% is achieved.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

REFERENCE LIST

1 Common hollow conductor, circular or square
2 Side arm hollow conductor, rectangular
3 Side arm hollow conductor, rectangular
5 Sum gate of a magic T junction
6 Side arm of a magic T junction
7 Side arm of a magic T junction
8 Difference gate of a magic T junction
10 Wave guide orthomode coupler
11 Common hollow conductor
21 Side arm hollow conductor
22 Side arm hollow conductor
23 Side arm hollow conductor
24 Side arm hollow conductor
25 Hollow conductor absorber
26 Hollow conductor absorber
27 First axis
28 Second axis
30 Main axis (longitudinal axis)
OMT Orthomode coupler
ANT Antenna
DH Diplexer
DV Diplexer
VRx vertically-polarized reception signal
HRx horizontally-polarized reception signal
VTx vertically-polarized transmission signal
HTx horizontally-polarized transmission signal

What is claimed is:

1. A broadband signal junction with sum signal absorption for transmitting signals, comprising: a common hollow conductor with a first predefined cross-section; and four side arm hollow conductors disposed in a common plane, the four side arm hollow conducts having a predefined cross-section, wherein two first opposing side arm hollow conductors extend along a first axis and two second opposing side arm hollow conductors extend along a second axis, wherein the first and the second axis are disposed orthogonal to one another lying in the common plane, and wherein the common plane runs orthogonally to a main axis of the common hollow conductor, wherein the two first side arm hollow conductors end with a hollow conductor absorber disposed over the respective predefined cross-section of the two first side arm hollow conductors, wherein each hollow conductor absorber of the two first side arm hollow conductors lie along and terminate on the first axis.

2. The broadband signal junction of claim 1, wherein the first predefined cross-section of the common hollow conductor is a group consisting of rectangular, square, elliptical, and round.

3. The broadband signal junction of claim 1, wherein the predefined cross-section of the four side arm hollow conductors is a group consisting of rectangular, square, elliptical, and round.

4. The broadband signal junction of claim 3, wherein the predefined cross-section of at least one of the four side arm hollow conductors is different from the predefined cross-section of another one of the four side arm hollow conductors.

5. The broadband signal junction of claim 1, wherein the two second side arm hollow conductors are disposed and/or designed collinear.

6. The broadband signal junction of claim 1, wherein the four side arm hollow conductors are disposed and/or designed offset from the common plane.

7. The broadband signal junction of claim 1, including a matching structure disposed inside of the junction, wherein the matching structure has a geometry matched to a desired transmission behavior and can have any arbitrary shape.

8. The broadband signal junction of claim 1, wherein the signals are split or coupled over an entire bandwidth with a phase shift of 180°.

* * * * *